United States Patent [19]

Whitefield

[11] 4,119,006

[45] Oct. 10, 1978

[54] CONTINUOUSLY VARIABLE ATTACK AND DECAY DELAY FOR AN ELECTRONIC MUSICAL INSTRUMENT

[75] Inventor: John Thomas Whitefield, Harleysville, Pa.

[73] Assignee: Allen Organ Company, Macungie, Pa.

[21] Appl. No.: 771,617

[22] Filed: Feb. 24, 1977

[51] Int. Cl.[2] ..... G10H 3/00

[52] U.S. Cl. ..... 84/1.13; 84/1.24; 84/1.26; 179/1 M

[58] Field of Search ..... 84/1.01, 1.03, 1.13, 84/1.24, 1.26; 179/1 J, 1 M

[56] References Cited

U.S. PATENT DOCUMENTS

| | | | |
|---|---|---|---|
| 3,610,800 | 10/1971 | Deutsch | 84/1.01 |
| 3,697,661 | 10/1972 | Deutsch | 84/1.01 |
| 3,749,837 | 7/1973 | Doughty | 84/1.01 X |

*Primary Examiner*—Ulysses Weldon
*Attorney, Agent, or Firm*—Seidel, Gonda & Goldhammer

[57] ABSTRACT

A digital musical instrument incorporating the effects of attack and decay by appropriately scaling the digitally synthesized waveform information at the leading and trailing portions of the waveform envelope. Such an instrument would be capable of producing two attack and decay periods with only one attack and one decay period resulting in the normal audible effect. The system is particularly adapted for use in an electronic musical instrument in which a digital multiplexed signal is generated by actuation of the keys of the instrument. The attack and decay periods generated by actuation and deactuation of the keys are processed such that each period is divided into "n" scale factors spaced in time, each such scale factor being associated with a different level of the waveform envelope. The scale factors cover the range of waveform envelope from zero to full scale. Upon receipt of a clear pulse, the digital counter begins counting, and would terminate the count upon reaching "n". If prior to the full count of "n", an additional clear pulse is generated, the counter resets to zero count and begins to count up again. For example, the clear pulse generated by a key actuation causes the attack and decay counter to be reset, thus beginning the attack mode and setting a flip-flop whose operation causes the scale factor to produce a zero amplitude waveform resulting in no audible sound production. At some predetermined count, a counter output decoder then generates a second counter clear pulse resetting the counter and the gating flip-flop thereby allowing the "n" scale factors to propagate through and produce an audible attack. The result is a delay time from the time of key actuation until the propagation of audio system output. The same principle applies to the decay mode. Upon deactuation of the key, the first set of "n" scale factors are forced to maintain full scale factor value and the second decay period is processed unaltered through the system producing the audible decay.

8 Claims, 5 Drawing Figures

DELAY DECODER

ATTACK/DECAY
SCALE FACTOR PROCESSOR

SIGNAL SOURCE SWITCH
FIG. 4
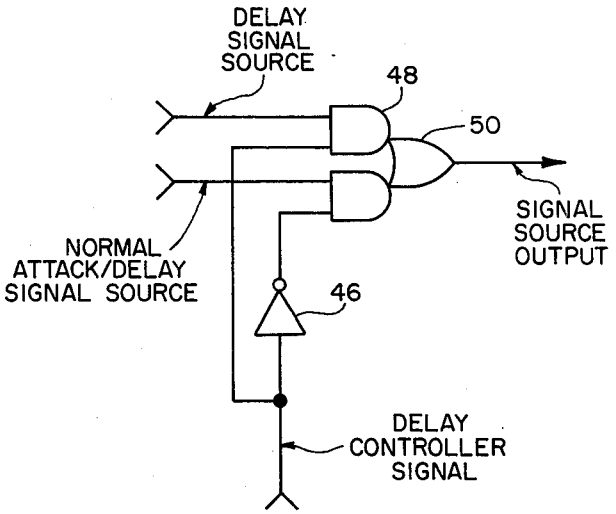
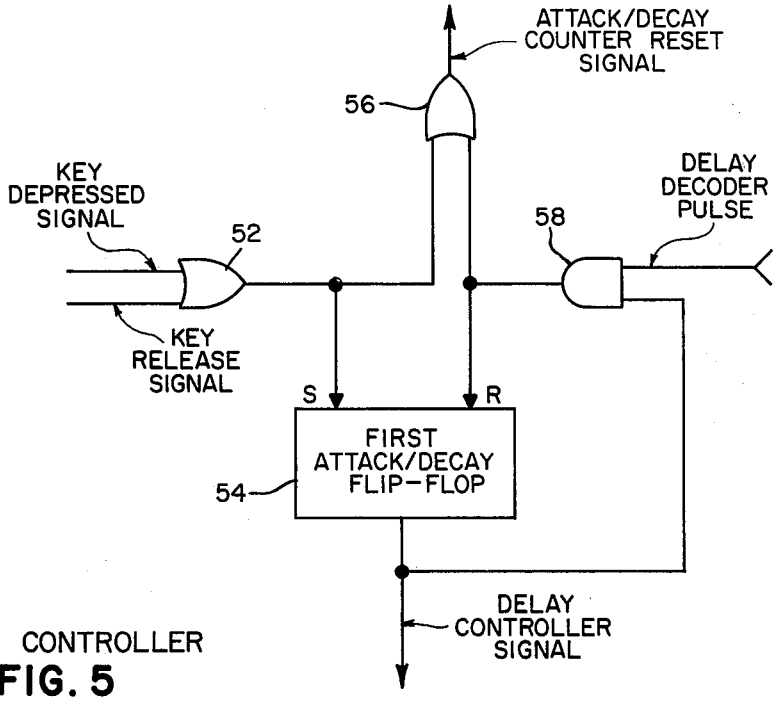
DELAY CONTROLLER
FIG. 5

CONTINUOUSLY VARIABLE ATTACK AND DECAY DELAY FOR AN ELECTRONIC MUSICAL INSTRUMENT

BACKGROUND OF THE INVENTION

1. Field of the Invention

This invention resides broadly in the field of electronic musical instruments, and is particularly adaptable for use in instruments employing a digital selection system for calling forth desired tones and voices from those available to be produced by the instrument. The principles of the present invention are applicable to any electronic musical instrument in which musical sounds are generated in response to the actuation of key switches regardless of whether those switches are actuated directly, i.e., by the musician's fingers, or indirectly, by the plucking of strings. The term key is used in a generic sense, to include depressible levers, actuable on-off switches, touch or proximity responsive devices, closable apertures and so forth. The present invention relates to the attack and decay characteristic of a musical note played on an electronic musical instrument. More particularly, the present invention relates to the delay of the attack and decay functions as normally generated in an electronic musical instrument.

2. Description of the Prior Art

Heretofore, delaying the attack or decay period required the use of elements such as analog or digital shift registers or random access memories. Conventional delay elements such as these can be used to create delayed audio signals by either delaying the keying information or by delaying the waveform information in digital form, or after conversion, in analog form. Delaying the digital keying information requires delay elements clocked by a constant clocking frequency determined by the digital instrument design. Under these conditions the amount of delay is solely determined by the size and quantity of delay elements used. Adjustments in delay time cannot be continuously adjustable as in the present invention but must be adjusted in increments determined by the particular delay elements used. Delaying the digital waveform information just prior to a digital to analog conversion must be accomplished in a manner similar to delayed keying and thus provides no advantage in controlling the delay time. Continuously adjustable delay times may be obtained by delaying the audio information after conversion either by digital techniques employing further analog to digital and digital to analog conversion or by analog bucket brigade delay elements. However, delaying in this manner has disadvantages not found in the present invention. Although continuously adjustable by adjusting the propagating clock frequency, this method is considerably more complex and costly in terms of hardware and, in addition, results in an audio output signal of reduced quality. This reduced quality comes in part from the fact that the audio information must be sampled at a rate determined by the propagating clock and thus is bandwidth limited. The bandwidth, as well as the desired delaying effect, is proportional to sampling frequency, and thus as the delay time is lengthened, the bandwidth is reduced. Additional deterioration in audio quality can come from analog to digital and digital to analog converters if the delay is implemented with digital delay elements. In accordance with the present invention, digital logic is used to create a second attack or decay period for each respective note. Additionally, digital logic is provided so as to prevent any audio effect of the first attack or decay period. A significant advantage of the present invention is the elimination of common delay elements and the continuously adjustable delay time available to the player without audio degradation.

SUMMARY OF INVENTION

The present invention provides a new and unobvious means of creating a dealy between the actuation or deactuation of a key switch and the audible effect of attack and decay which is normally produced by these actions. The term attack and decay period as used herein refers to the time period between the actuation of a key switch and the time when the note reaches its maximum amplitude and the time period between the deactuation of a key switch and the time when the note reaches zero amplitude. The present invention provides a significant advantage in that digital electronic techniques may be used to generate continuously adjustable sound delay without the use of conventional delay elements and without sacrificing sound quality.

This invention is particularly useful in digital electronic musical instruments. More particularly, the present invention is especially suitable for use in a digital organ of the general type described in U.S. Pat. Nos. 3,515,792 and 3,610,799 wherein actuation of a key effects the gating of a pulse into a time slot of a time division multiplex system, each key in the instrument being assigned to a particular time slot.

Briefly, in accordance with the present invention there is provided an apparatus for generating multiple attack and decay periods such that the audible effect of selected attack and decay periods may be disabled. Upon key actuation there are generated two attack periods in succession. During the first attack period whose time is continuously adjustable, the audio output is disabled and thus no sound is heard. Prior to the end of the first attack, the attack and decay generating means is signaled to repeat the attack period and propagate the audible effect of the second attack. The result is a delayed response from the time the key is actuated until sound is heard. Delayed decay is accomplished in a similar way; however, during the first decay period the audible output is forced to full value, while during the second decay period the audible output decays to a zero final value.

In accordance with a more detailed aspect of the invention, a delayed attack and decay generating means may be comprised of an attack and decay counter whose "*n*" states correspond to "*n*" scale factors, each scale factor being associated with a level of sound amplitude. The outputs of the attack and decay counter are fed through a plurality of NAND gates whose function is to inhibit the counter output during the delay time. The outputs of the NAND logic circuitry are fed to a plurality of exclusive - OR logic circuits which distinguish the attack mode from the decay mode. The NAND gates are controlled by a flip flop which differentiates between the respective attack and decay periods. This flip flop in conjunction with an electronic switch determines the signal source that will be used during the first and second attack and decay period. At a predetermined count during the first attack or decay a decoder generates a pulse which resets the flip flop enabling the generation of the second attack or decay period. Simultaneously the counter signal source is switched back to the normal attack and decay signal source and the NAND gates are once again allowed to pass the count information on to the exclusive - OR gates and in turn to propagate through the musical instrument system.

BRIEF DESCRIPTION OF THE DRAWINGS

For the purpose of illustrating the invention, these are shown in the drawing forms which are presently preferred; it being understood, however, that the invention is not limited to the precise arrangement and instrumentalities shown.

FIG. 4 is a logic diagram of 24 Signal Souce Switch of FIG. 1.

FIG. 5 is a logic diagram of 30 Delay Controller of FIG. 1.

DESCRIPTION OF THE PREFERRED EMBODIMENT

Figure 1:
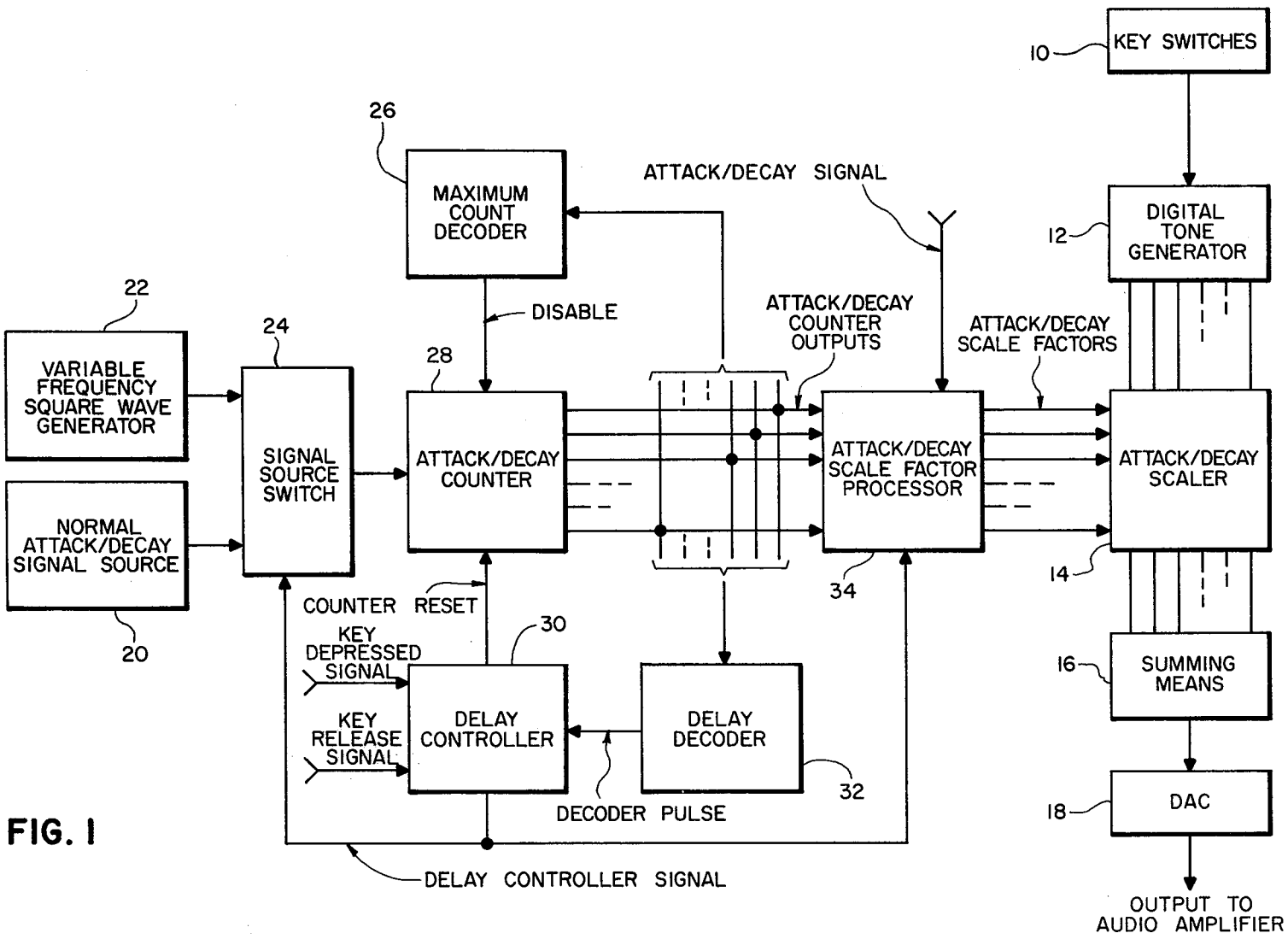
FIG. 1 is a schematic diagram, in block form, of the preferred embodiment in accordance with the present invention.

Referring now to the drawings in detail, wherein like numerals indicate like elements, there is shown in FIG. 1 a block diagram of a system in accordance with the present invention.

In FIG. 1 there is shown a set of key switches or keys 10. The key switches or keys 10, which will be referred to herein as keys, may be the keys of the various electronic musical instruments. Digital electronic organs or digital electronic musical instruments in which the present invention may be applied and used are described in detail in U.S. Pat. No. 3,515,792 of which the inventor was Ralph Deutsch and U.S. Pat. Nos. 3,639,913 and 3,610,799 of which the inventor was George Watson. Reference may be had to these patents for a detailed description of the components referred to herein other than the continuously variable attack and decay delay producing structural relationships in accordance with the invention.

Digital tone generator 12 has digital representations of audio waveform stored in memory. Within tone generator 12 a frequency synthesizer in response to depression of a key switch 10 produces a readout of these digital representations at the rate Mf, where $f$ is the frequency of the note selected and M is the number of sample points along the stored waveform. This is consistent with prior art and techniques as set forth in U.S. Pat. Nos. 3,515,792; 3,610,799; and 3,639,913. The waveform amplitude samples which are derived by the digital tone generator 12 are acted upon by the attack and decay scaler 14 and waveform envelope attack and decay scale factors to impart the gradual effects of attack and decay as set forth in U.S. Pat. No. 3,610,805 of which the inventors were Ralph Deutsch and George Watson.

Figure 3:
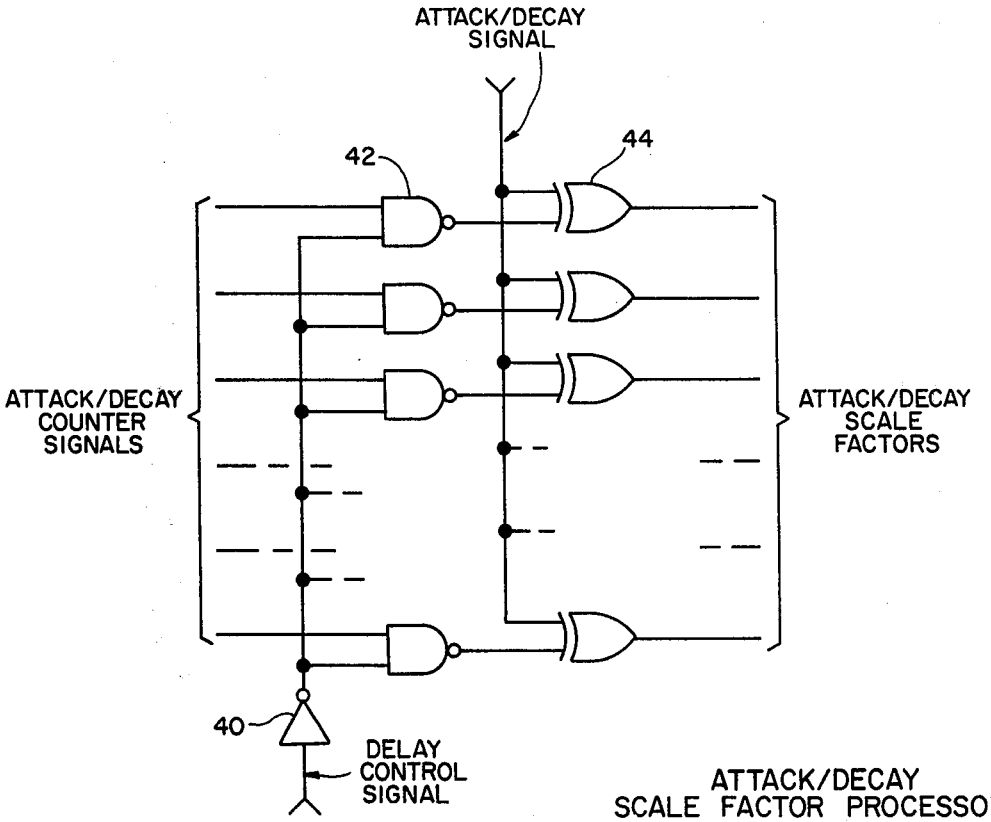
FIG. 3 is a logic diagram of 34 Attack/Decay Scale Factor Processor of FIG. 1.

The attack and decay scale factors are generated by attack and decay counter 28 and attack and decay scale factor processor 34. Attack and decay counter 28 is a three input modulo "$n$" binary up counter where "$n$" is the number of scale factors in the selected attack or decay period. Counter 28 reset input is used to force an all "0" condition on the outputs, signal source 20 or 22 advances the counter, and the disable input will disable the signal source when the maximum count has been reached. The counter 28 reset signal is generated in the delay controller 30 based on information related to key depression-key release pulses and the first attack or decay complete signal. First attack or decay complete signal will be more fully explained further on herein as the output function of AND gate 58, FIG. 5. The disable input signal is generated by maximum count decoder 26 in response to a full count or all "1's" output from counter 28. Thus when counter 28 is reset there is no disable signal present and the counter advances at a rate determined by the signal input until the maximum count is once again reached. Counter 28 and decoders 26 and 32 are constructed using techniques familiar to the art. Signal source switch 24 provides a means for inputting one signal source 22 to counter 28 during the delayed attack or decay time period and a different signal source 20 during the normal attack or decay time period. Signal source 22 is a variable freqaency square wave generator. Signal source 20 generates a signal consistent with a predetermined attack and decay function associated with the frequency of the note selected. (see U.S. Pat. 3,610,799, FIG. 10) Reference to FIG. 4 will provide a typical implementation of signal source switch 24. As is shown in FIG. 4 the signal source switch can be implemented with AND gates 48, OR gate 50 and inverter 46, such that a "1" level from the delay controller will enable the passage of the delay signal source 22 and disable the normal attack and decay signal source 20. A "0" from the delay controller will enable the normal attack and decay signal source and disable the delay signal source. As a result of signal source switch 24 it is possible to control the input to counter 28. The outputs from counter 28 are applied to attack and decay scale factor processor 34 which performs two functions. A first function is to provide a means for inhibiting the counter 28 outputs from propagating through to attack and decay scaler 14 during the delay mode. A second function is to distinguish between the attack and decay modes. FIG. 3 shows a typical implementation of the attack and decay scale factor processor. Referring to FIG. 3 it can be seen that there is a plurality of NAND gates 42 which act to inhibit the passage of attack and decay counter signals during the delay time. A "1" level from the delay controller is inverted by inverter 40 thereby causing a "0" level on the common inputs of NAND gates 42 and forcing the NAND gates 42 to output a "1". Conversely, a "0" on inverter 40 will cause a "1" on the common inputs of NAND gates 42 thereby inverting the attack and decay counter signals propagated by attack and decay counter 28. The inverted attack and decay counter signals are applied to a plurality of exclusive OR gates 44 where as a function of the logic level of the attack and decay signal, they will be propagated to the attack and decay scaler 14 of FIG. 1 as scale factors. For the sake of a clear understanding of the invention, the characteristics of an attack and decay signal as utilized in the preferred embodiment of the present invention should be as follows. The attack and decay signal is a digital signal whose logical states are used to distinguish the attack mode from the decay mode. For example, the signal logic could be such that a logic "1" would represent the attack mode and logic "0" the decay mode. In the normal organ mode, that in which the instrument produces a sound as long as the key remains depressed, the signal assumes a logic "1" upon key depression and remains at logic "1" until the key is released. Upon key release the signal assumes logic "0" and the sound level decreases to zero. In the piano or percussion mode, that in which the instrument responds to a key depression such that the audible effect is one of rapidly rising attack to full scale followed immediately by decay, the signal assumes logic "1" during the attack and after reaching full scale assumes logic "0" thereby causing decay.

With the foregoing explanation in mind, it becomes possible to further describe the function of the attack and decay scale factor processor 34 of FIG. 1. During the attack delay time period the delay controller 30 signal will force "1's" on the outputs of NAND gates 42 which in turn are inverted by exclusive - OR gates 44 and independent of the action of counter 28 will force the audio signal level to zero. Thus exclusive - OR gates 44 provide inversion when the attack and decay signal is a "1" and no inversion when the attack and decay signal is a "0". During the normal attack time period NAND gates 42 will output the inverted attack and decay counter signals to the exclusive -OR gates 44 with the net effect of no inversion through the attack and decay scale factor processor 34. Under the above described conditions, the attack and decay scale factor processor 34 inputs and outputs are identical and result in an audible attack signal. During the decay delay time period the delay controller 30 signal forces "1's" on the output of NAND gates 42. Since the attack and decay signal during the decay period is "0", there is no inversion through the exclusive - OR gates 44. As a consequence of this, during the decay delay time period the scale factor processor outputs are forced to "1" and independent of the action of counter 28 will force the audio signal to full level. During the normal decay period the scale factor processor outputs are the inverse of scale factor inputs. Therefore, as the attack and decay counter 28 counts from a condition of all "0's" to all "1's" the scale factors as presented to the attack and decay scaler will go from a condition of all "1's" to all "0's". As a consequence of this, the audible output will decrease from full scale value to zero.

In accordance with the concept of the present invention, there are generated two attack periods and two decay periods. The means for generating the required periods is shown in FIG. 1 as delay controller 30 and delay decoder 32. Referring to FIG. 5 an expanded view of delay controller 30, it can be seen that data representing key depression and key release information are combined in OR gate 52 resulting in one signal representative of key switch activity. Upon key depression a single positive going pulse is generated and upon key release another single positive going pulse is generated. The generation of key depressed and key released signals is consistent with the technique set forth more fully in U.S. Pat. Nos. 3,610,799 and 3,610,805 in FIG. 7B. Prior to the actuation of any key switch flip-flop 54 is in the reset state, that is the Q output is at a "0" level. Presentation of a positive going pulse from OR gate 52 output causes the flip-flop 54 to be set to a "1" state and an attack and decay counter reset signal to be generated at the output of OR gate 56. The set condition of flip-flop 54 signifies the delayed attack or decay mode. The appearance of a "1" level on the output of flip-flop 54 causes the selection of the delay signal source by signal source switch 24 of FIG. 1, the disabling of attack and decay counter signals in scale factor processor 34 of FIG. 1, and the enabling of AND gate 58 of FIG. 5. The second input of AND gate 58 is the delay decoder pulse from delay decoder 32 of FIG. 1. AND gate 58 generates an attack or decay complete signal which resets flip-flop 54 and propagates through OR gate 56 to reset attack and decay counter 28 signifying the end of the delay mode, to initiate the second attack or decay period and to assure that no further decoder pulse will halt the counter 28 prior to full count.

Figure 2:
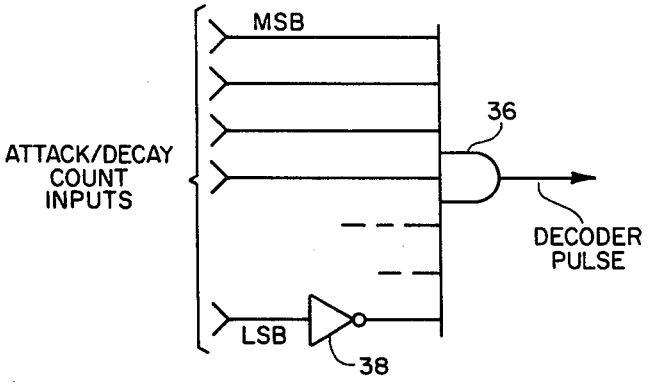
FIG. 2 is a logic diagram of 32 Delay Decoder of FIG. 1.

Referring to FIG. 2, an expanded view of delay decoder 32 of FIG. 1, the decoder consists of a multi-input AND gate 36 with an inverter 38 on the least significant bit (LSB) input. Delay decoder 32 and maximum count decoder 26 differ only by the value of counter 28 at which a decoder pulse is generated. Delay decoder 32 produces an output prior to the output of maximum count decoder 26. The function of the delay decoder 32 is to detect a predetermined "*n*" state of attack and decay counter 28, FIG. 1 and to permit the resetting of the counter 28 prior to full count. The delay decoder 32 may be arranged to decode any of the "*n*" states of counter 28. As a result of delay decoder 32 resetting flip-flop 54, the "0" level output of flip-flop 54 causes signal source switch 24 of FIG. 1 to select the normal attack and decay signal source. Counter 28, FIG. 1 using the normal attack and decay signal source continues to count at a rate determined by the normal attack and decay up to the "*nth*" state whereupon the signal source input is disabled by the maximum count decoder and the count remains fixed. The fixed count will continue until key release information is received whereupon the delay decay mode would operate as explained herein with the ultimate result that the normal decay would decrease the output to zero level.

The present invention may be embodied in other specific forms without departing from the spirit or essential attributes thereof and, accordingly, reference should be made to the appended claims, rather than to the foregoing specifications as indicating the scope of the invention.

I claim:

1. In a digital electronic musical instrument having switches selectively actuable to cause the production of sounds corresponding to respective notes of the musical scale and an attack and decay signal whose logic states distinguish between an attack mode and a decay mode, an apparatus for delaying the audible attack and/or decay period comprising:

a digital up counter for counting through the "*n*" states of a selected period at a rate determined by the frequency of a signal source, a first signal source means for advancing said digital up counter, a second signal source means for advancing said digital up counter, a switching means for selecting between said first and second signal source, a delay decoder means for generating a pulse upon detection of a predetermined "*n*" state of said digital up counter, a delay controller means for indicating the delay mode and resetting said digital up counter, a maximum count decoder means for terminating the advance of said digital up counter upon detection of some predetermined "*n*" state of said digital up counter, and a processor means responsive to said attack and decay signal and said delay controller signal for modifying said digital up counter output.

2. The digital electronic musical instrument in accordance with claim 1 wherein said delay controller means is responsive to key depressed - key release information and delay decoder output.

3. The digital electronic musical instrument in accordance with claim 2 wherein said maximum count decoder is responsive to the "*nth*" state of said digital up counter.

4. The electronic musical instrument in accordance with claim 1 wherein said second signal source means generates a variable frequency signal.

5. The digital electronic musical instrument in accordance with claim 1 wherein said second signal source means is a square wave signal generator.

6. The digital electronic musical instrument in accordance with claim 1 wherein said second signal source means is an adjustable frequency square wave signal generator.

7. The digital electronic musical instrument in accordance with claim 1 wherein said first signal source generates a signal consistent with a predetermined attack and decay function associated with the frequency of the note selected.

8. A method of obtaining continuously variable attack and decay delay in a digital electronic musical instrument wherein an attack and delay signal is generated whose logic states distinguish between an attack mode and a decay mode which method comprises:

a. counting with a counter through the "*n*" states of an attack and decay period at a rate determined by the frequency of a signal source;
b. generating a first signal source for advancing said counter;
c. generating a second signal source for advancing said counter;
d. selecting between said first and second signal sources for advancing said counter;
e. decoding a predetermined "*n*" state of said counter;
f. controlling with a controller the selecting between said first and second signal sources for advancing said counter;
g. decoding the "*nth*" state of said counter, and
h. modifying the output of said counter through a processor responsive to said attack and decay signal and said controller.

* * * * *

UNITED STATES PATENT OFFICE

CERTIFICATE OF CORRECTION

PATENT NO. : 4,119,006

DATED : October 10, 1978

INVENTOR(S) : JOHN THOMAS WHITEFIELD

It is certified that error appears in the above-identified patent and that said Letters Patent are hereby corrected as shown below:

In Column 8, Line 1:

"delay" is changed to --decay--.

Signed and Sealed this

*Third* Day of *April 1979*

[SEAL]

*Attest:*

RUTH C. MASON
*Attesting Officer*

DONALD W. BANNER
*Commissioner of Patents and Trademarks*